US010646762B2

(12) United States Patent
Bowers

(10) Patent No.: US 10,646,762 B2
(45) Date of Patent: May 12, 2020

(54) SURFACE MOUNTED BALL AND NET DEVICE

(71) Applicant: Michael Bowers, Thousand Oaks, CA (US)

(72) Inventor: Michael Bowers, Thousand Oaks, CA (US)

(73) Assignee: Michael Bowers, Thousand Oaks, CA (US)

( * ) Notice: Subject to any disclaimer, the term of this patent is extended or adjusted under 35 U.S.C. 154(b) by 0 days.

(21) Appl. No.: 14/878,822

(22) Filed: Oct. 8, 2015

(65) Prior Publication Data

US 2017/0100652 A1 Apr. 13, 2017

(51) Int. Cl.
*A63B 63/00* (2006.01)
*A63B 63/08* (2006.01)

(52) U.S. Cl.
CPC ..... *A63B 63/00* (2013.01); *A63B 63/08* (2013.01)

(58) Field of Classification Search
CPC ..... A63B 63/00; A63B 63/08
USPC ..... 273/398–402; 473/478, 28, 197, 439, 473/447, 448, 485, 489; 383/33, 102, 383/117, 121.1; D34/39; D9/702–706; D21/302, 303, 305
See application file for complete search history.

(56) References Cited

U.S. PATENT DOCUMENTS 131,303 A * 9/1872 Sabin ..... B65D 29/00 220/904
229,333 A * 6/1880 Preater ..... A61F 7/086 383/121.1
516,194 A * 3/1894 Freer ..... B65D 29/00 220/904
613,383 A * 11/1898 Morgan ..... A63B 67/06 273/402
1,232,827 A * 7/1917 Milbauer ..... B65D 33/10 220/904
D153,239 S * 3/1949 Schwartz ..... 273/382
2,533,904 A * 12/1950 Urban ..... A63B 39/00 273/400
3,035,838 A * 5/1962 Johnston ..... A63F 9/0204 273/400
4,291,885 A 9/1981 Cohen
4,335,881 A * 6/1982 Warehime ..... A63B 63/08 273/348
4,828,270 A * 5/1989 Chiang ..... A63B 63/00 273/401
D327,928 S * 7/1992 Cochran ..... 473/485
5,297,798 A * 3/1994 Davila-Hernandez ..... A63B 59/20 273/342

(Continued)

*Primary Examiner* — Melba Bumgamer
*Assistant Examiner* — Laura Davison
(74) *Attorney, Agent, or Firm* — Ferguson Case Orr Paterson

(57) ABSTRACT

Described herein are game devices for use in individual and/or group play. These game devices can compose a base and an intermediate structure comprising an opening which a user can attempt to throw a ball or other object into. The base can be configured such that it can connect to a substantially planar surface such as a wall or ceiling. The intermediate structure can be flexible like a basketball net or can be rigid. In some embodiments, the opening in the intermediate structure can be connected to a rim that hold the opening in an "open" position. In some embodiments, the rim can further comprise bristle-like protrusion structures.

18 Claims, 5 Drawing Sheets

(56) References Cited

U.S. PATENT DOCUMENTS 5,346,228 A * 9/1994 Offutt ..... A63B 63/00 473/471
5,374,054 A 12/1994 Suess
5,524,881 A * 6/1996 Edward ..... A63B 63/08 273/400
5,536,003 A * 7/1996 Brenner ..... A63B 63/083 273/402
5,692,979 A 12/1997 Jones
5,909,833 A * 6/1999 Smith ..... A45F 3/02 224/577
5,980,401 A * 11/1999 Erlewine ..... A63B 63/083 473/481
6,006,772 A * 12/1999 Zheng ..... A63B 9/00 135/117
6,398,673 B1 6/2002 Maruca
6,431,393 B1 * 8/2002 Stewart ..... B65D 37/00 220/213
6,520,365 B2 * 2/2003 Schneider ..... A45C 7/0077 220/666
6,887,171 B2 * 5/2005 Hochfeld ..... A63B 63/08 273/348
7,011,311 B2 3/2006 Hochfeld
7,237,777 B2 * 7/2007 Digges, III ..... A63B 67/06 273/400
7,390,274 B2 6/2008 Bradford
7,427,244 B1 9/2008 Patel
8,453,864 B2 * 6/2013 Krueger ..... A47G 19/30 220/229
9,084,908 B1 * 7/2015 Chen ..... A63B 5/11
9,199,149 B2 * 12/2015 Max ..... A63B 63/08
2009/0264226 A1 * 10/2009 Mauro ..... A63B 63/083 473/488
2011/0130225 A1 6/2011 Sims
2016/0101334 A1 * 4/2016 Worthy ..... A63B 67/002 273/401

* cited by examiner

SURFACE MOUNTED BALL AND NET DEVICE

BACKGROUND

Field of the Invention

Described herein are devices relating generally to games, for example, sport-like games, and specifically devices for playing such sport-like games, for example, net devices for use with a ball or other thrown object.

Description of the Related Art

Throughout the ages, humankind has created various different sports and sport-like games for the purpose of providing exercise, entertainment and passing the time. To this end, various devices for use in these games were created. For example, for the game basketball, a rim and net substantially perpendicular with a backboard was created to allow a user to throw or "shoot" a ball into the rim and net, either directly or with the aid of ricochet from the backboard.

Different sports, sport-like games, and devices for use therein, are constantly being developed with each novel and original game or device providing increased game variety and additional available forms of entertainment. One area of entertainment that is particularly of interest is that of individual or solo games that one can play by themselves or with another participant. These individual games provide a user with a convenient pastime that can be participated in with or without another person present. A classic example of such a game is paddle ball, in which a paddle comprising a gripping portion and a base has an elastic string connected to the base at one end, with a ball at the other end. A user can play a game by himself or herself by hitting the ball with the base portion, which will cause the ball to extend the string and then return to be hit again.

One class of desirable and entertaining sports that could benefit from individual player variants include ball and net type games such as soccer and basketball. An example conventional attempt to create a ball and net game similar to basketball is set forth in U.S. Pat. No. 5,374,054 to Matthew Suess. This game allows a user sitting upright to attempt to shoot a basket in a basketball-like setup utilizing a device with a rim and net substantially perpendicular with a backboard. There is a slide-like portion that allows for the ball to return to the seated user so that user can repeat the game.

One issue with contemporary individual ball and net type games, such as the example set forth above, is that the devices for their use are bulky and take up a lot of space, making setup inconvenient and decreasing their storage and portability options. Furthermore, these games tend to simulate the basic basketball goal itself and do not provide a novel game or net-like device for playing such a game.

SUMMARY

Described herein are game devices for use with a ball or other thrown object. In some embodiments, the game devices can comprise one or more openings through which a user attempts to throw a ball or other object in order to make a "goal." In some embodiments, these game devices can be configured for individual play. These game devices can comprise a base, an intermediate structure and a rim.

In some embodiments, the rim can be flexible and/or net-like and in some embodiments the intermediate structure can be rigid. In some embodiments, the rim can further comprise protrusions configured to make goal-scoring more obvious and provide a delay for the ball or other object exiting the game device.

In one embodiment, a game device comprises a base and an intermediate structure. The intermediate structure comprises a first end comprising a first opening and a second end comprising a second opening, with the first end connected to the base such that the first opening is at least partially blocked by said base.

In another embodiment, a game device comprises a base, a flexible intermediate structure, with the intermediate structure comprising at least a first end and a second end. The first end is connected to the base and the second end comprises an opening. A rigid rim structure is connected to the second end near the opening.

In still another embodiment, a game device comprises a base and an intermediate structure. The intermediate structure comprises a first end comprising a first opening and a second end comprising a second opening. The first end is connected to the base such that the first opening is completely blocked by the base. A rigid rim structure is connected to the second end near the second opening and the width of the intermediate structure tapers from the first end to said second end.

These and other further features and advantages of the invention would be apparent to those skilled in the art from the following detailed description, taken together with the accompanying drawings, wherein like numerals designate corresponding parts in the figures, in which:

DETAILED DESCRIPTION

Figure 1:
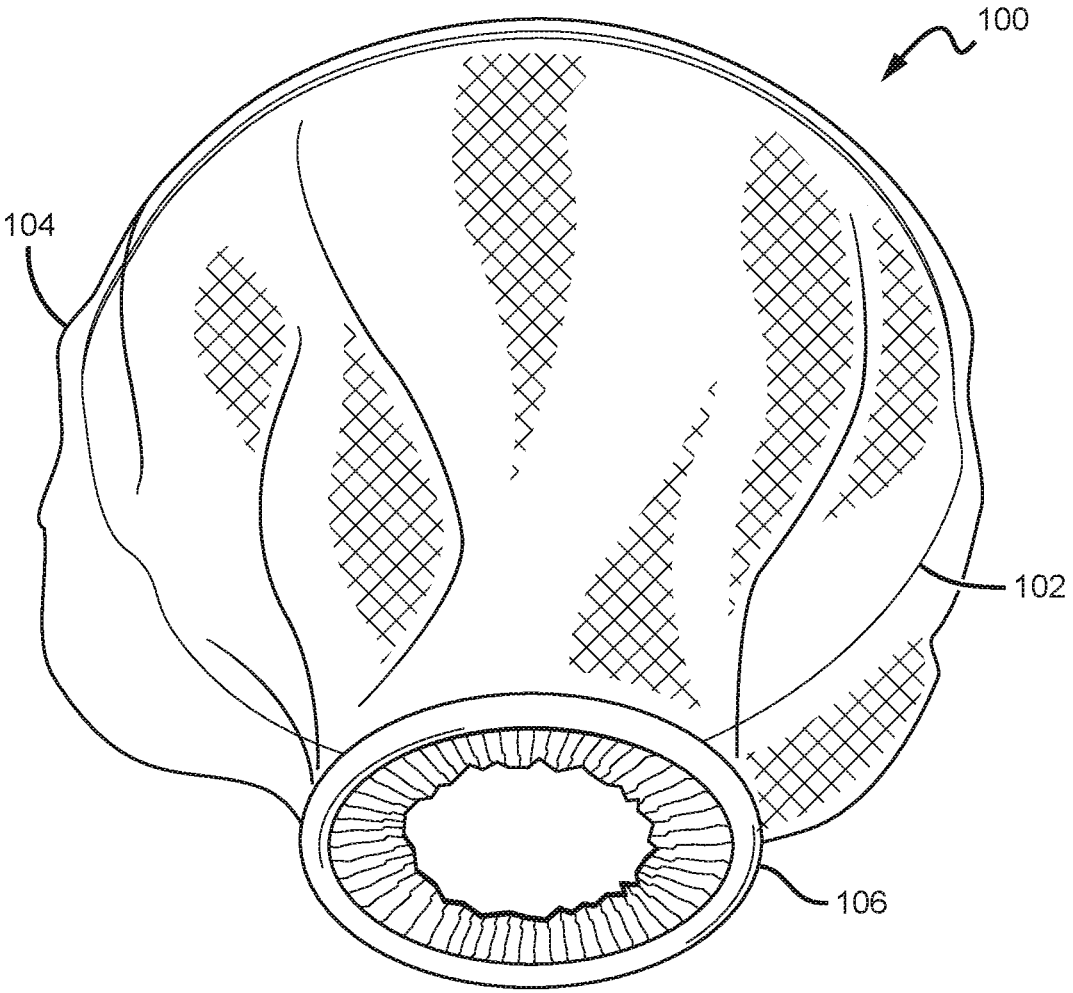
FIG. 1 is a front, top, perspective view of an embodiment of a game device incorporating features of the present invention.

The present invention is described herein with reference to certain embodiments, but it is understood that the invention can be embodied in many different forms and should not be construed as limited to the embodiments set forth herein. These embodiments set forth devices pertaining to games and sporting games that can be played either individually or in a group. The game devices can comprise a base and an intermediate structure.

In some embodiments, the intermediate structure comprises at least two openings with a first opening being at least partially blocked by the base and a second opening being exposed such that a user can attempt to throw a ball or other object though the second opening. In some embodiments, the first opening is completely blocked by the base.

In some embodiments, the game devices can comprise a rim structure near the second opening and configured to keep the second opening open. The rim structure can be rigid, and in some embodiments, comprises bristle-like protrusions to further control the passage of a ball or other thrown object through the second opening as will be discussed further below.

In some embodiments, the base can be connected to a ceiling and a user can stand, sit or lay down below the game device. The intermediate structure, especially in flexible embodiments, will hang from the base with the second opening facing the user. The user can through a ball or other object upwards and attempt to throw the ball into the second opening and therefore into the intermediate structure of the device. The ball will then roll down the sides of the intermediate structure due to gravity and exit the device through the second opening to return to the user positioned below the device.

Throughout this description, the preferred embodiment and examples illustrated should be considered as exemplars, rather than as limitations on the present invention. As used herein, the term "invention," "device," "present invention," or "present device" refers to any one of the embodiments of the invention described herein, and any equivalents. Furthermore, reference to various feature(s) of the "invention," "device," "present invention," or "present device" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. It is also understood that when an element is referred to as being "attached," "connected" or "coupled" to another element, it can be directly attached, connected or coupled to the other element or intervening elements may be present. In contrast, when an element is referred to as being "directly attached," "directly connected" or "directly coupled" to another element, there are no intervening elements present.

Relative terms, such as "outer," "above," "lower," "below," "horizontal," "vertical" and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein, but are to include deviations in shapes that result, for example, from manufacturing.

It is understood that when a first element is referred to as being "between," "sandwiched," or "sandwiched between," two or more other elements, the first element can be directly between the two or more other elements or intervening elements may also be present between the two or more other elements. For example, if a first element is "between" or "sandwiched between" a second and third element, the first element can be directly between the second and third elements with no intervening elements or the first element can be adjacent to one or more additional elements with the first element and these additional elements all between the second and third elements.

It is understood that the term "throw" as used herein, for example, as in referring to a user "throwing" a ball or other object, includes any method of launching, shooting, propelling or otherwise projecting such an object through space. For example, in some embodiments, a user may physically throw the object, over-handed, under-handed, or utilizing a basketball-like shooting motion. In some embodiments, a user might use an additional launching device, such as a gun-like or slingshot-like device to propel an object through space and make a goal utilizing devices incorporating features of the present invention.

An embodiment of a game device 100 incorporating features of the present invention is shown in FIG. 1. Some basic components of the game device 100 common to many embodiments incorporating features of the present invention include the base 102 and the intermediate structure 104. Some embodiments further comprise a rim structure 106, which can be rigid to define and/or hold open an opening in the game device 100, for example, an opening in the intermediate structure 104.

The base 102 can provide structural integrity and support to other portions of the game device 100, for example the intermediate structure 104 and/or can provide a mounting surface for the game device 100 to be connected to a surface, for example, substantially planar surface, such as a wall or ceiling. The base 102 can comprise at least two sides, with a first side facing toward the intermediate structure 104 and the second side facing opposite the first side. In some embodiments, the second side of the base 102 can be connected to a surface, for example, a substantially planar surface.

The base 102 can comprise any suitable material, for example, any suitable material to support the weight and dimensions of the intermediate structure 104 while the base 102 is connected to a surface. In some embodiments, the base 102 comprises a substantially rigid material or an at least partially rigid material, while the intermediate structure 104 comprises a flexible material. The base 102 can comprise any suitable material that can support the structure and function of the game device 100 as set forth in the present disclosure including, but not limited to, resin, rubber, vinyl, polyurethane, poly vinyl chloride (PVC), Poly(methyl methacrylate) (PMMA), polystyrene foam, polymers/copolymer substances, acrylic substances, plastic, leather, metal, glass, fiberglass, wood, cloth or a combination thereof. The base 102 can also comprise any suitable material known for use with sports games and equipment. In some embodiments, the base structure 102 comprises a material that is soft, semi-soft, or shock-absorbent and can muffle noise or prevent damage caused to a surface, such as a wall or ceiling, connected to the base 102 if the base 102 is struck by a ball or other thrown object.

The base 102 can be formed by any suitable method, for example, molding, injection molding, stamping/pressing, three-dimensional printing, extrusion and/or any methods known in the art of sports games and equipment manufacturing. While the base 102 is shown in the figures to be generally round or circular in nature, it is understood that the body can comprise any number of different shapes and sizes. For example, the base 102 can comprise any shape or structure that can support the structure and function of the game device 100 as set forth in the present disclosure including, for example, any regular or irregular polygon or a shape imitating a caricature or real-world object, for example, the face of a popular cartoon character or a basketball backboard.

The base can be configured to be connected to a surface utilizing a variety of configurations. In some embodiments, the base 102 is substantially planar and therefore is configured to be placed on a substantially planar surface such that the base 102 will not be hindered or deformed by the contours of the surface and such that the surface will make substantial contact with multiple portions of the base. The base can be connected to a surface through any known connection methods, for example, through use of permanent, semi-permanent and temporary adhesives, the use of fastening components, for example, screws, hooks, nuts, bolts and nails, or any connection methods known.

In some embodiments, the base structure 102 can comprise integrated connection features, for example, the base 102 can comprise a "peel and stick" adhesive, wherein a thin film layer can be removed from the portion of the base 102 opposite the intermediate structure 104 and therefore expose an integrated adhesive layer. In some embodiments, the base can comprise other connection features, for example, on the surface of the base 102 opposite the intermediate structure 104. In these embodiments an additional sub-connection structure can be utilized. This additional sub-connection structure can be first connected to a surface at a first point and then connected the base 102 at a second portion.

The base 102 can comprise connection features that can interact or mate with corresponding connection features of the additional sub-connection structure. For example, the base 102 can comprise a hook and loop structure such as Velcro®, with the additional sub-connection structure comprising a corresponding structure. In some embodiments, no additional sub-connection structure is utilized. In some embodiments, one or more additional sub-connection structures are utilized. It is also understood that in some embodiments, a base 102 is not utilized and the intermediate structure 104 can be connected to a surface without a base 102.

The intermediate structure 104 can be configured to connect to the base 102 and can be rigid or flexible. The intermediate structure 104 can be configured such that it is the intermediate portion of the game device 100 between the base 102 and an at least partially unblocked opening, such as one maintained by the rim structure 106. In embodiments wherein the intermediate structure 104 is rigid, the game device 100 can be utilized by connecting the base 102 to a substantially vertical surface, such as a wall.

The rigidity of the intermediate structure 104 in these embodiments allows an open end of the intermediate structure, for example, an opening maintained by the rim 106, to face a user and to extend in a direction substantially perpendicular to the vertical surface without concerns of the intermediate structure "drooping" due to gravity as may occur in embodiments wherein the intermediate structure is flexible. In the embodiments wherein the intermediate structure comprises a flexible material, a user throwing a ball or other thrown object into an exposed opening will result in the device providing a satisfying "swish" effect similar to a basketball net.

The intermediate structure 104 can comprise any of the materials listed herein in reference to the materials the base 102 can comprise, as well as any material known to be a net-like (i.e. utilized in the manufacture of netting) or mesh-like material. In some embodiments, the intermediate structure 104 can comprise a flexible material and/or structural configuration, for example, in some embodiments, the intermediate structure can comprise a net-like structure or a mesh-like material. In the embodiments wherein the intermediate structure is flexible, it can be connected to the base at one portion, for example, at one end of the intermediate structure 104 and can hang suspended from the base structure 102 when the base structure is connected to a surface.

Figure 2:
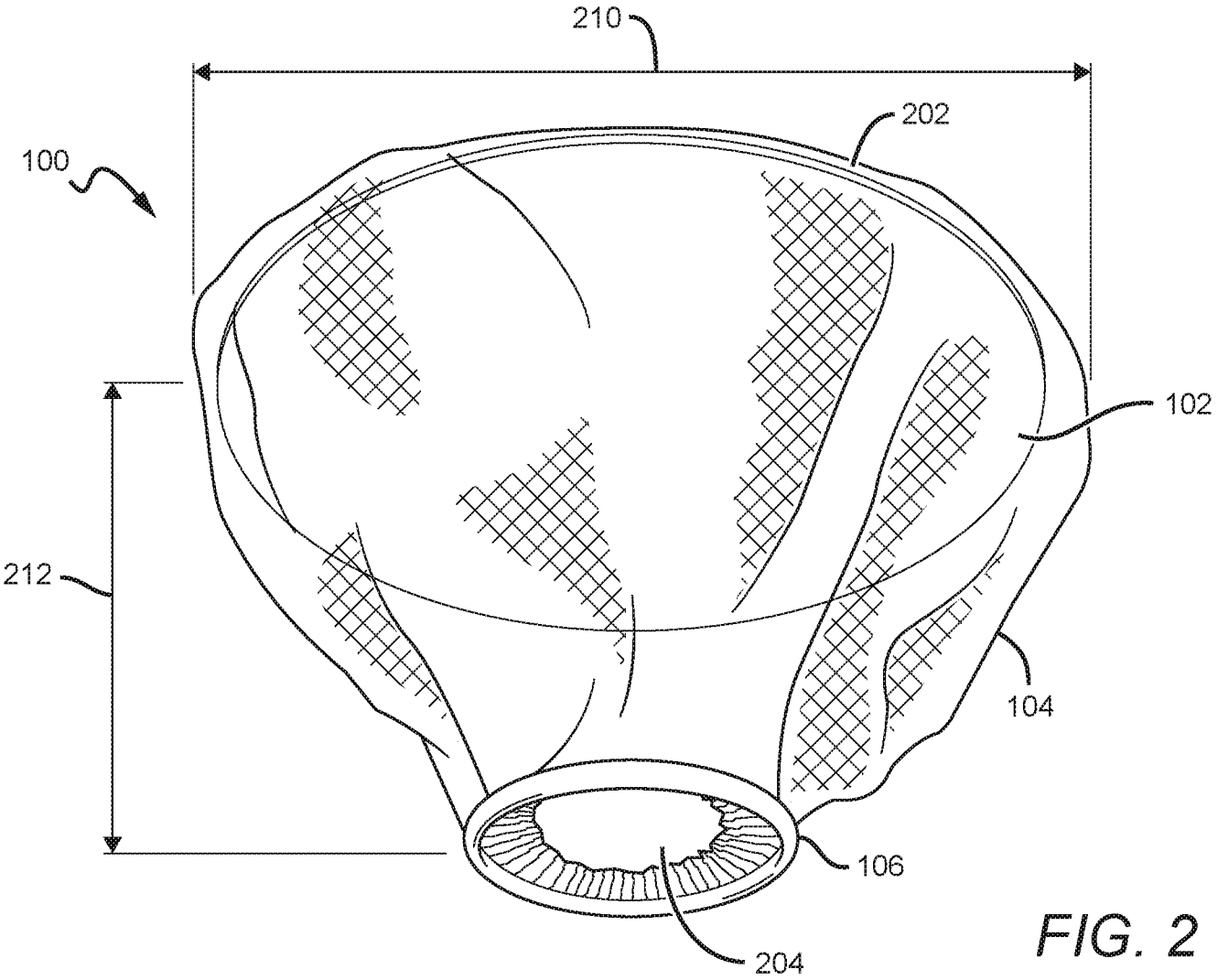
FIG. 2 is a front perspective view of the embodiment of the game device of FIG. 1.

The intermediate structure 104 can comprise one or more openings, which is more clearly shown in FIG. 2, which shows the game device 100 comprising the base 102, the intermediate structure 104, and the rim 106. In the embodiment shown in FIG. 2, the intermediate structure 104 comprises two openings, a first opening 202 at a first end of the intermediate structure 104 and a second opening 204 at a second end of the intermediate structure 104, although it is understood that in some embodiments, the game device 100 can comprise greater than two openings or fewer than two openings.

The first opening 202 can be connected to the base 102 such that the first opening 202 is at least partially blocked by the base structure 202. In the embodiments shown in FIG. 2, the perimeter of the first opening 202 is connected around the perimeter of the base 102 such that the base 102 completely blocks the first opening 202. This prevents or lessens the chance that a ball or other object thrown into the game device 100 will exit from the first opening 202 and therefore the game device 100.

The second opening 204 provides an opening in the intermediate structure 104, through which a user can attempt to throw a ball or other object into in order to attempt to make a goal. In some embodiments, the second opening 204 is simply suspended in space and is an opening within the intermediate structure 104. In some embodiments, the second opening 204 is connected to or near the rim 106, which can provide structure to the second opening 204, can define the shape of the second opening 204 and/or can maintain or hold the second opening 204 open.

The intermediate structure 104 can comprise a wide variety of shapes, including any regular or irregular polygon. In some embodiments, the intermediate structure 104 can comprises a cylindrical or funnel-like shape with two openings and a pliable interface therebetween. As shown in FIG. 2, the intermediate structure 104 can be tapered in shape and can vary in size and/or width 210 along its length 212. In some embodiments, such as the embodiment shown in FIG. 2, the width 210 of the intermediate structure 104 tapers, for example, reduces, from the first opening 202 to the second opening 204.

Figure 3:
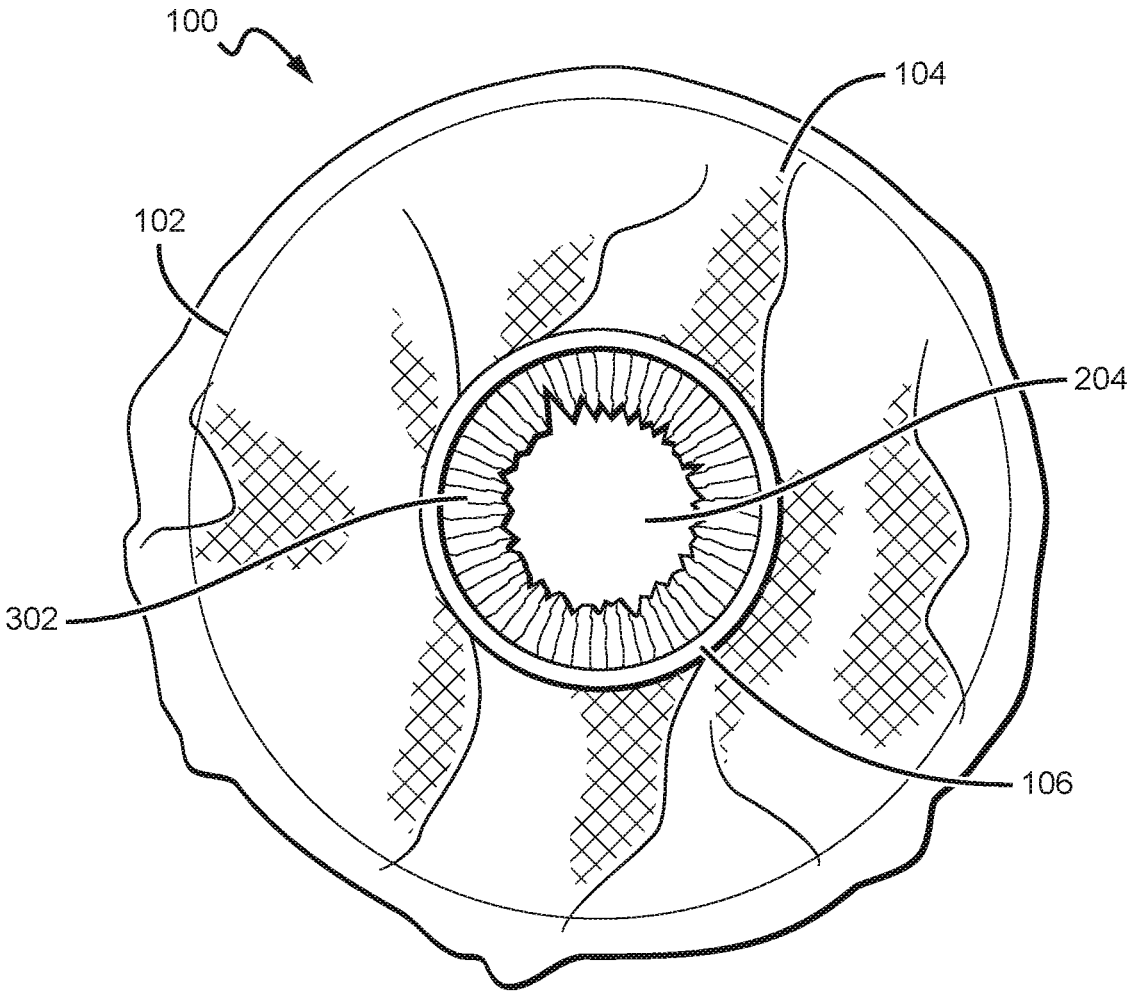
FIG. 3 is a top view of the embodiment of the game device of FIG. 1.

The rim 106 is more clearly shown in FIG. 3, which shows the game device 100 comprising the base 102, the intermediate structure 104, and the rim 106. The rim 106 can comprise any of the materials listed herein in reference to the materials the base 102 can comprise, with a preferred material being rigid and capable of maintaining a predetermined shape. The rim 106 can define, maintain and/or hold open the second opening 204, which is particularly advantageous in embodiments wherein the intermediate structure 104 comprises a flexible material. This is due to the fact that a user throwing a ball or other object through the second opening 204 of a flexible intermediate structure 104 can hit the edges of the second opening 204 and cause the flexible intermediate structure 104 to move, thus complicating the process of making a goal. With a rigid rim 106 in place, the second opening 204 is substantially maintained, making it easier for a user to score a goal.

The rim 106 can comprise any suitable shape that can maintain and/or hold open the second opening 204, including any regular or irregular polygonal shape. In some embodiments, the rim 106 can be roughly circular or elliptical and/or comprise a ring-like shape. In some embodiments, the rim 106 is one continuous structure and in some embodiments, the rim 106 can comprise multiple components, for example, a double-ring structure comprising a first ring on and/or connected to a second ring. In some embodiments, the rim 106 can comprise further connections features for connecting one or more portions of the intermediate structure 106 to the rim 106. These connection elements can include hooks or various known connection elements.

In some embodiments, the rim 106 can further comprise additional structures to enhance gameplay, for example, one or more protrusions 302. The protrusions 302 protrude from the rim 106 and extend into the second opening 204 such that the protrusions at least partially block the second opening 202. The protrusions 302 can comprise any of the materials listed herein in reference to the materials the base 102 can comprise, with a preferred material being semi-rigid yet being collapsible under the weight of the thrown ball or other object used to play the game with the game device 100. In some embodiments, the protrusions 302 are not on or part of the rim 106, but are on or part of another structure adjacent to the rim 106 and extend to a location in or near the rim 106.

In some embodiments, the protrusions 302 comprise a fiber-like or bristle-like material, for example, a material similar to that utilized for toothbrush bristles. The protrusions 302 help make it more obvious when a goal is scored as the ball or other thrown object moves the protrusions 302 as it enters the game device 100 from the second opening 204 causing a visual effect of the protrusions 302 moving as well as sound.

Furthermore, the protrusions 302 provide a minimal resistance to a ball or other thrown object that has entered and is rolling out of the game device 100. As the protrusions 302 can comprise a material that provides some resistance but will move under the weight of the thrown object, the object rolls out at a slower rate than embodiments without the protrusions 302 and briefly stops at the second opening 204 before rolling out of the game device 100. This provides a user with increased time and notice in which to catch or otherwise receive an exiting thrown object.

Figure 4:
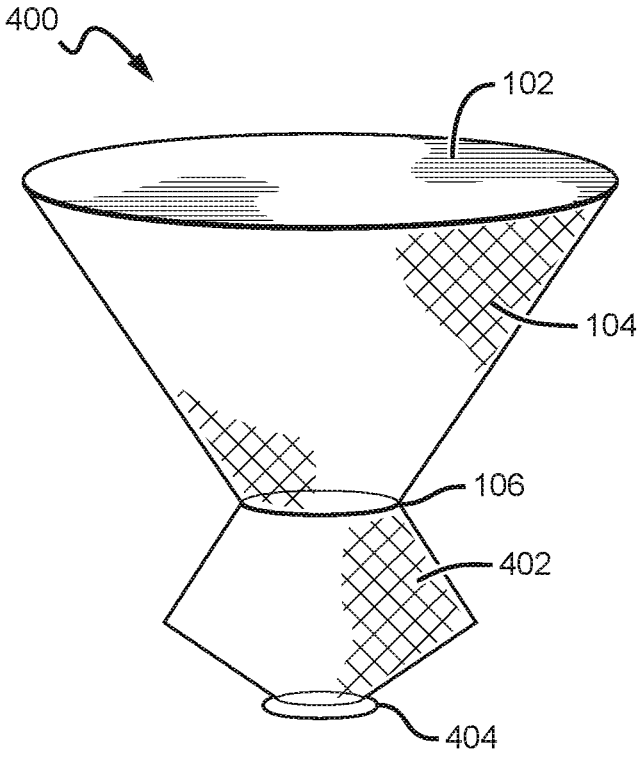
FIG. 4 is a front perspective schematic view of another embodiment of a game device incorporating features of the present invention.

Further embodiments of game devices incorporating features of the present invention may comprises multiple intermediate structures. FIG. 4 shows a game device 400, which like the game device 100 in FIGS. 1-3 above, comprises a base 102, an intermediate structure 104, and a rim 106. However, unlike the game device 100 in FIGS. 1-3 above, the game device 400 in FIG. 4 comprises an additional intermediate structure 402, connected to and extending from the first rim 106 at a first end and an additional rim 404 connected to a second end of the additional intermediate structure 402. These embodiments allow for a variation of the basic game in which the user can attempt to make a goal such that the ball or other thrown object enters the first intermediate structure 104 or the additional intermediate structure 402.

In more complex embodiments incorporating features of the present invention, the game devices can comprises various additional features, for example electronic features that generate lights and sounds, for example light emitting diodes (LEDs) and/or electric sound components. In some embodiments, the game devices comprise an electronic timer or scoreboard. In some embodiments, the devices can comprise wired or wireless remote control features that can operate or move portions of the device or reset and control the timer or scoreboard.

Figure 5:
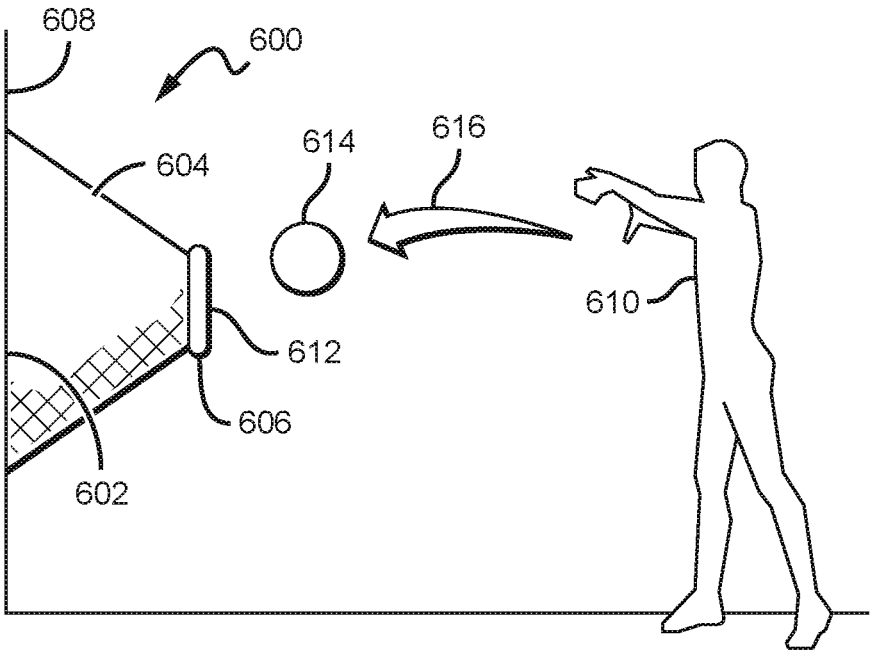
FIG. 5 is a schematic representation of a method for use of yet another embodiment of a game device incorporating features of the present invention.
Figure 6:
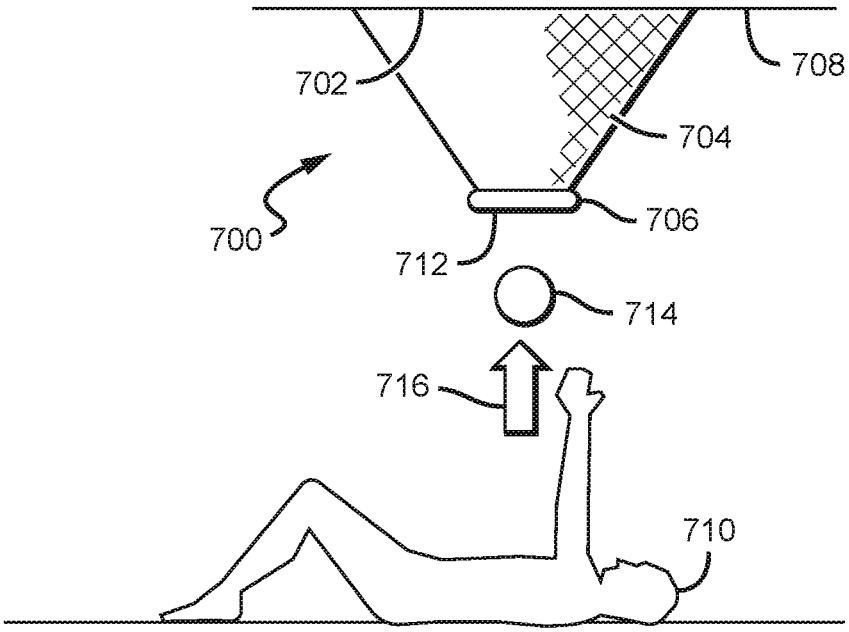
FIG. 6 is a is a schematic representation of a method for use of yet another embodiment of a game device incorporating features of the present invention.

Two example methods for playing games with game devices incorporating features of the present invention are shown in FIGS. 5-6. FIG. 5 shows a game device 600, similar to the game device 100 in FIGS. 1-3 above, comprising a base 602, an intermediate structure 604 and a rim 606. In the embodiment shown, the base 602 of the game device 600 is connected to a substantially planar and vertical wall 608. As shown in FIG. 5, the game device 600 comprises a rigid intermediate structure 604, allowing the game device to face a user 610 such that the opening 612 faces the user 610 and the device 600 is substantially perpendicular to the vertical wall 608. As shown in FIG. 5, the user 610, who may be standing, seated or lying down, throws a ball 614 (or other object) in a horizontal direction as indicated by the schematic force arrow 616 in FIG. 5. The user 610 attempts to throw the ball 614 into the opening 612.

FIG. 6 shows a game device 700, similar to the game device 100 in FIGS. 1-3 above, comprising a base 702, an intermediate structure 704 and a rim 706. In the embodiment shown, the base 702 of the game device 700 is connected to a substantially planar and horizontal ceiling 708. As shown in FIG. 5, the game device 700 comprises a flexible intermediate structure 704, allowing the game device 700 to face a user 710 such that the opening 712 faces the user 710 and the intermediate structure 704 hangs suspended from the base 702.

As shown in FIG. 6, the user 710, who may be standing, seated or lying down, throws a ball 714 (or other object) in a vertical direction as indicated by the schematic vertical force arrow 716 in FIG. 6. The user 710 attempts to throw the ball 714 into the opening 712. The ball 714 will then roll out of the device 700 due to gravity and the user 710 can catch the ball 714 and repeat the process.

One preferred embodiment of a solitary game that can be played with game devices incorporating features of the present invention includes positioning the game device similarly to as shown in FIG. 6, with the base connected to a ceiling. A user then throws a ball or other objected into the device through the second opening of the intermediate structure. Gravity then causes the ball or objected to slide out of the device through the second opening and return to the user, making this a repeatable process.

It is understood that while the present disclosure describes game devices incorporating features of the present invention utilizing a ball, any suitable object that can be thrown can be utilized to attempt to make a goal. Various balls can be utilized, including but not limited to, baseballs, softballs, basketballs, golf balls, rubber balls, tennis balls, balls specifically designed to be played with game devices as disclosed herein and any known ball. In some embodiments, discus-like objects or beanbag-like objects can be utilized with devices incorporating features of the present invention.

Game devices incorporating features of the present invention can provide several additional advantages aside from the entertainment value of providing a game to play. For example, in some embodiments, these devices can be used for training sport game skills, for example, teaching proper form for ball throwing or shooting. In some embodiments, these devices can be utilized to provide mental/physical therapy or exercise and can improve hand-eye coordination, for example, being utilized to provide accuracy training, strength training or self-esteem building.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention as expressed in the appended claims, wherein no portion of the disclosure is intended, expressly or implicitly, to be dedicated to the public domain if not set forth in the claims.

I claim:

1. A game device, comprising:

a shock-absorbent base comprising a first side and a second side opposite said first side;

a connection feature for connecting said game device to a ceiling, said connection feature on said first side of said base, said connection feature comprising an adhesive or a first part of a hook and loop structure configured to connect to a second part of the hook and loop structure attached to the ceiling;

an intermediate structure extending from said second side of said base, said intermediate structure comprising a first end comprising a first opening, and a second end comprising a second opening, said first end connected to said base, said intermediate structure comprising a length from said first opening to said second opening, wherein said intermediate structure comprises a plurality of apertures along said length and is flexible such that said intermediate structure is unbiased toward a particular position and said intermediate structure hangs suspended when said base is connected to the ceiling using said connection feature; and a rim structure connected to said second end at or near said second opening;

wherein said base blocks said first opening of said first end of said intermediate structure.

2. The game device of claim 1, wherein said intermediate structure comprises a mesh structure.

3. The game device of claim 1, wherein a width of said intermediate structure tapers from and beginning at said first end to said second end.

4. The game device of claim 1, wherein said rim structure further comprises protrusions extending into said second opening.

5. The game device of claim 1, wherein said base is substantially circular.

6. The game device of claim 1, wherein said rim structure maintains a predetermined ring shape.

7. The game device of claim 1, wherein said rim structure is distinct from said intermediate structure.

8. The game device of claim 1, wherein said base is distinct from said intermediate structure.

9. The game device of claim 1, wherein said connection feature comprises said adhesive.

10. The game device of claim 1, wherein said connection feature comprises said first part of the hook and loop structure.

11. The game device of claim 1, wherein said intermediate structure is a net.

12. A game device, comprising:

a base comprising a first side and a second side facing opposite said first side, wherein said base is shock-absorbent;

an adhesive connection feature for connecting said game device a ceiling, said adhesive connection feature on said second side of said base;

an intermediate structure, said first side of said base facing toward said intermediate structure, said intermediate structure comprising at least a first end and a second end, said first end connected to said base and said second end comprising an opening, said intermediate structure comprising a length from said first end to said second end, wherein said intermediate structure comprises a plurality of apertures along said length and is flexible such that said intermediate structure is unbiased toward a particular position and said intermediate structure hangs suspended when said base is connected to the ceiling; and a ring-like rim structure connected to said second end at or near said opening;

wherein said ring-like rim structure comprises protrusions that are part of said ring-like rim structure and extend into said opening such that the protrusions at least partially block the opening.

13. The game device of claim 12, wherein said intermediate structure comprises a mesh structure.

14. The game device of claim 12, wherein the protrusions are semi-rigid.

15. The game device of claim 12, wherein the protrusions are collapsible.

16. The game device of claim 12, wherein said ring-like rim structure is distinct from said intermediate structure.

17. The game device of claim 12, wherein the protrusions are around an entire perimeter of said ring-like rim structure.

18. The game device of claim 12, wherein said intermediate structure is a net.

* * * * *